US006285290B1

(12) United States Patent
Kouznetsov

(10) Patent No.: US 6,285,290 B1
(45) Date of Patent: Sep. 4, 2001

(54) SELF-CLEANING OVEN HAVING SMOKE DETECTOR FOR CONTROLLING CLEANING CYCLE TIME

(75) Inventor: Andrian Kouznetsov, Santa Barbara, CA (US)

(73) Assignee: SPX Corporation, Muskegon, MI (US)

( * ) Notice: Subject to any disclaimer, the term of this patent is extended or adjusted under 35 U.S.C. 154(b) by 0 days.

(21) Appl. No.: 09/593,341

(22) Filed: Jun. 14, 2000

(51) Int. Cl.[7] ..... G08B 17/10

(52) U.S. Cl. ..... 340/630; 340/628; 219/393; 250/574; 356/438; 432/120

(58) Field of Search ..... 340/628, 630; 219/393; 356/438; 432/120; 250/574

(56) References Cited

U.S. PATENT DOCUMENTS 3,809,913 * 5/1974 Prellwitz ..... 340/630
4,351,701 * 9/1982 Bauer ..... 340/628
4,557,203 * 12/1985 Mainord ..... 110/344
5,826,520 * 10/1998 Mainord ..... 110/342
6,046,441 * 4/2000 Daffron ..... 340/628

* cited by examiner

*Primary Examiner*—Daniel J. Wu
(74) *Attorney, Agent, or Firm*—Pepper Hamilton LLP

(57) ABSTRACT

An improved self-cleaning oven (10) is provided having an assembly (12) to control the cleaning cycle time of the oven (10) depending upon the degree of oven contamination and soil present therein. The assembly (12) includes a measuring chamber (16) as well as a passageway (18) communicating the interior (14) of the oven (10) and the chamber (16). A smoke detector (32) (preferably an infrared smoke detector) is associated with the chamber (16) and is coupled with a controller (20) so as to measure a parameter of smoke passing through the chamber during at least a portion of the cleaning cycle. This parameter is then used to determine the proper duration of the cleaning cycle. In preferred forms, measuring chamber (16*a*) is equipped with an ambient air inlet (52) and outlet (54) so as to draw an ambient air stream through the chamber (16*a*) between the smoke detector (32) and the oven gas stream.

19 Claims, 2 Drawing Sheets

SELF-CLEANING OVEN HAVING SMOKE DETECTOR FOR CONTROLLING CLEANING CYCLE TIME

BACKGROUND OF THE INVENTION

1. Field of the Invention

The present invention is broadly concerned with improved self-cleaning ovens including an assembly to control the duration of the high-temperature oven cleaning cycles. More particularly, the invention pertains to such ovens, cycle controlling assemblies and methods wherein a parameter of at least a portion of the smoke generated during an oven cleaning cycle is measured and the duration of the cleaning cycle is determined in response to such measurement.

2. Description of the Prior Art

Many household and industrial ovens are equipped with self-cleaning cycles. When an oven is soiled, the user initiates a cleaning cycle, which involves heating of the oven to a very high temperature (e.g., 800° F.) so as to sublimate the oven contaminants. Conventional cleaning cycles operate for a preset period of 2–4 hours so as to insure that all such contaminants are removed from oven surfaces. During the course of a cleaning cycle, smoke is generated as the contaminants char and are sublimated. Usually the period of greatest smoke is during the initial thirty minutes or so of a cycle. Thereafter, smoke production tails off and becomes less prevalent.

A problem with conventional self-cleaning ovens is that the cleaning cycle is conducted for a preset period, regardless of the amount of soil and contaminants in the oven. Thus, the same amount of high temperature operation is carried out for a heavily or lightly soiled oven. This not only unnecessarily takes the oven out of service for longer than may be necessary, but also wastes significant energy.

There is accordingly a need in the art for improved self-cleaning ovens which will terminate an oven cleaning cycle after different periods of heating, in a manner commensurate with the level of soil and contaminants in the oven.

SUMMARY OF THE INVENTION

The present invention overcomes the problems outlined above and provides an oven cleaning cycle time-controlling assembly for use with self-cleaning ovens. The cycle time-controlling assembly of the invention operates by measuring a parameter of at least a portion of the smoke generated during an oven cleaning cycle, and by ascertaining the appropriate cycle duration in response to such measurement.

The preferred controlling assembly of the invention includes a sensing chamber together with a delivery system (e.g., a passageway) communicating the oven interior and the sensing chamber in order to convey at least a portion of the smoke evolved during the cleaning cycle to the sensing chamber. A smoke detector is associated with the sensing chamber in order to measure the smoke parameter of interest. Advantageously, the smoke detector is a conventional infrared smoke detector which is coupled with an electronic controller, in order to measure the a parameter of smoke generated during at least a portion of the cleaning cycle.

An on-off valve may be interposed within the delivery system between the oven and chamber and is also coupled with the controller. During normal oven usage, the valve is closed so as to prevent passage of oven gas to the measuring chamber. The valve is opened during the course of the cleaning cycle to allow passage of oven gas and smoke to the measuring chamber. Also, an in-line smoke filter may be interposed in the delivery system to remove the largest smoke particles. This reduces the rate of smoke contamination of the sensor chamber and other components.

DETAILED DESCRIPTION OF THE PREFERRED EMBODIMENT

Figure 1:
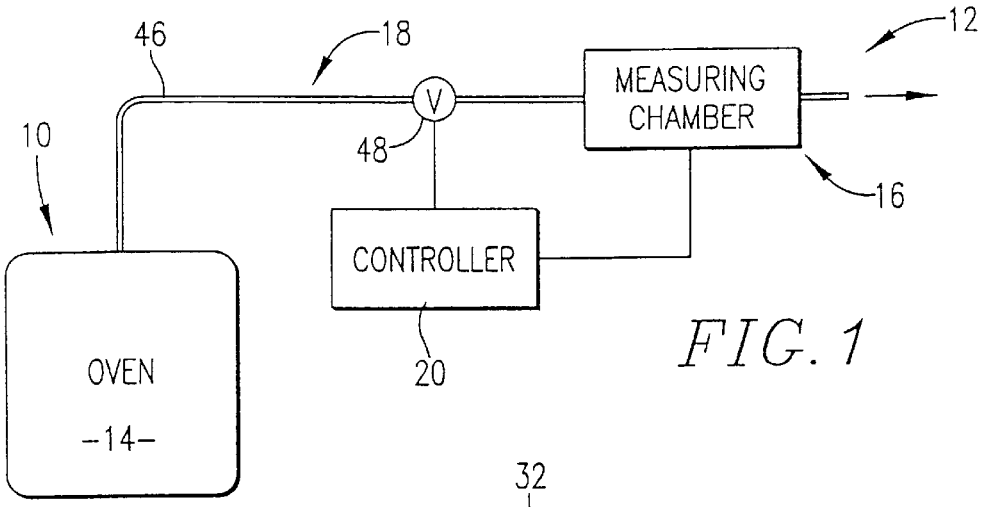
FIG. 1 is a schematic representation of a self-cleaning oven with the preferred cleaning cycle time-controlling assembly of the invention coupled thereto.

Turning now to the drawings, FIG. 1 illustrates an oven 10 in combination with the cleaning cycle time-controlling assembly 12 of the invention. Broadly speaking, the oven 10 is itself conventional and presents an interior 14. The oven 10 is of the self-cleaning variety which is controlled by conventional control and timing electronics. The assembly 12 includes a measuring chamber 16 as well as a delivery system 18 which communicates oven interior 14 and the chamber 16. A controller 20 also forms a part of the assembly 12.

Figure 2:
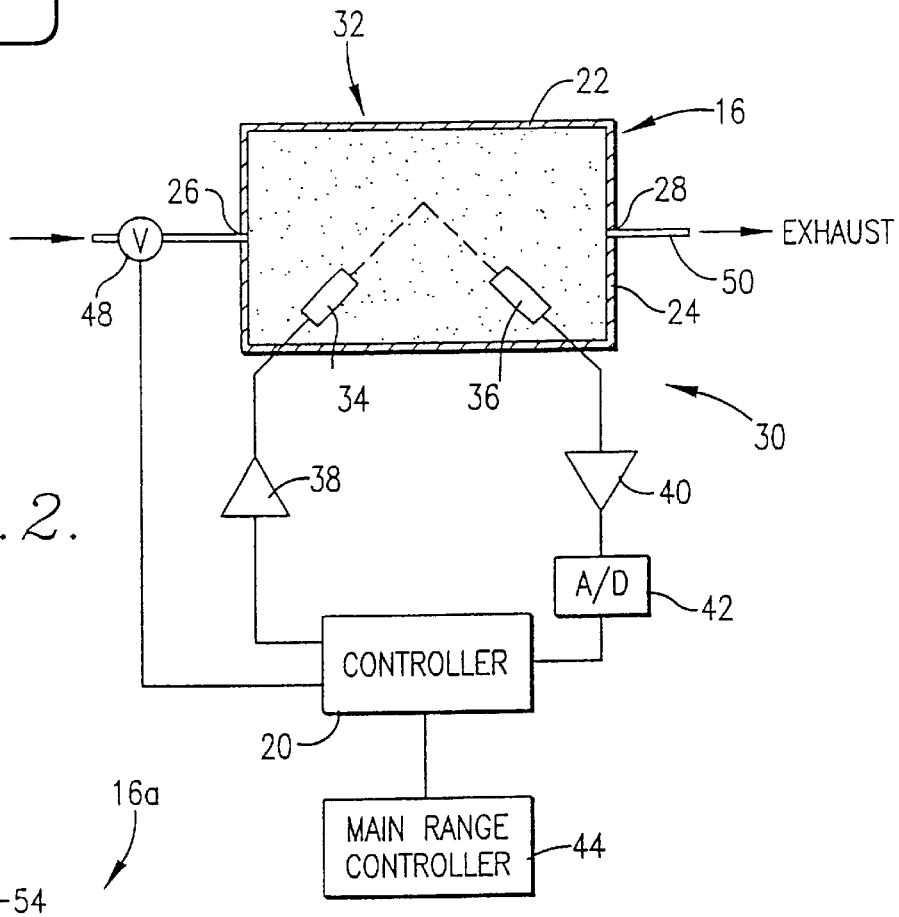
FIG. 2 is a schematic view illustrating the preferred construction of the measuring chamber forming a part of the cleaning cycle time-controlling assembly.

In more detail, the measuring chamber 16 is preferably molded from high temperature-rated synthetic resin materials and is in the form of small tubular or box-like enclosure 22 presenting exterior walls 24 as well as an oven gas inlet 26 and an opposed oven gas outlet 28. The chamber 16 is equipped with a sensor 30 in the form of an infrared smoke detector 32. The detector 32 includes an infrared light emitting diode (LED) 34 as well as a spaced infrared detector 36. The LED 34 and detector 36 are placed within the enclosure 22 and are oriented so that smoke passing through the chamber 16 will be detected. As illustrated in FIG. 2, these components are angularly disposed relative to each other so that infrared radiation emitted by LED 34 will be scattered by the smoke (usually containing solid particles and various types of volatile organic compounds (VOCs)), and a portion of such scattered radiation is detected by the detector 36.

It will be understood that the enclosure 22 illustrated in the drawings is of simplified design. In practice, the enclosure may simply be of tubular configuration with a diameter similar to that of the tube 46, so that the volume of the enclosure is less than that of the delivery system 18. Also, the chamber may include provision for preventing LED radiation from reaching the IR detector when there is no smoke within the enclosure. Such may include special wall shapes, internal partitions, or IR black coating on the interior of the chamber. Also, the enclosure may have provision for verification for smoke sensor performance, such as a special opening that allows insertion of a calibrated scattering media (such as a simple piece of plastic or fabric) instead of smoke.

The controller 20 is connected to the LED 34 and detector 36 for control thereof. Specifically, the controller is electrically coupled to an infrared LED driver 38, and the output of the latter is connected to LED 34. An amplifier 40 and analog-to-digital converter 42 are connected in series between the detector 36 and controller 20 as illustrated. The main range controller 44 which is connected to and controls oven 10 is also connected to the controller 20.

The delivery system 18 is preferably in the form of an elongated metallic tube 46 which is connected to oven 10 and to input 26 of the enclosure 22. An on-off valve 48 is interposed within tube 46 between oven 10 and chamber 16. The valve is also coupled with controller 20 which controls the on-off operation thereof.

Figure 3:
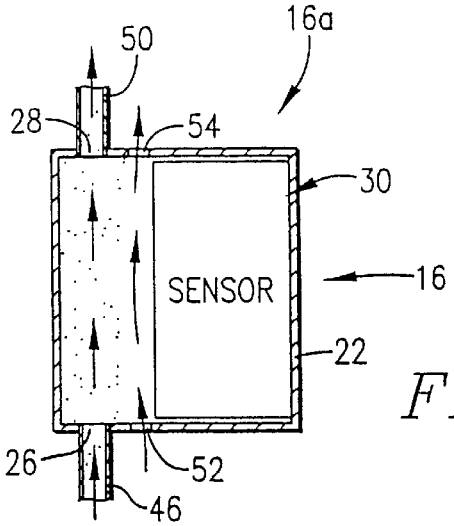
FIG. 3 is a schematic representation of the preferred measuring chamber, equipped with spaced openings for drawing ambient air through the measuring chamber during use thereof.

Turning next to FIG. 3, a modified measuring chamber 16*a* is illustrated. In this case, enclosure 22 includes the oven gas inlet and outlet 26, 28 with the tube 46 coupled to the former. An exhaust tube 50 is connected to oven gas outlet 28. In this instance however, the enclosure 22 is also provided with a pair of opposed openings 52, 54 which are an ambient air inlet and an ambient air outlet respectively. The openings 52, 54 are located between the oven gas inlet and outlet 26, 28, and the sensor 30.

During normal use of oven 10 for the baking of foods and the like, assembly 12 does not come into play. That is, the valve 48 remains closed so that oven gases cannot pass through tube 46 to chamber 16. However, when it is desired to clean oven 10 using the self-cleaning cycle thereof, initiation of the cycle through the main range controller 44 also initiates operation of controller 20. When this occurs, the valve 48 is opened at a predetermined time, thereby allowing oven gas and a portion of the smoke generated as a result of the cleaning cycle to pass through the tube 46 and thus into and through the chamber 16. During passage of the oven gas and smoke through the chamber 16, the smoke detector 32 is operated via controller 20 so as to repeatedly measure the smoke intensity over a period of time. In preferred practice, the quantity of smoke is measured during the initial phase of the oven cleaning cycle, which generates most of the smoke which will be evolved during the cycle. For example, the smoke intensity within chamber 16 during an initial period of the cleaning cycle may be used for controlling the time of the cleaning cycle.

In more detail, it will be understood that the smoke detector 32 measures a signal proportional to light scattered from the smoke within the chamber 16. Data is acquired by iteratively measuring the output signal of the IR detector 36 as I(i), typically every 10 seconds after the cleaning cycle is initiated. In the first step, a I(i) baseline is determined by measuring the detector output signal during the initial no smoke stage of the cleaning cycle. When the detector 36 senses a low predetermined threshold of smoke SO, a time t1 is noted and a series of smoke intensity S(i) determinations are made. These S(i) values are calculated using the equation S(i)=C×(I(i) measured−I(i) baseline), where C is a scaling coefficient, and I(i) measured is the detector value obtained at each measurement time. These S(i) values are determined until an S(i) value falls below the threshold SO, this being noted as time t2. The S(i) values obtained during the time period between times t1 and t2 are used to calculate the scattered signal power P, which is the average of the S(i) values determined between t1 and t2. Using the scattered signal power P, the duration of the cleaning cycle time T can be obtained either from a lookup table or using the polynomial function:

$$T=a0+a1\times P+a2\times P^2+a3\times P^3+\ldots$$

where a0, a1 and a2 are predefined polynomial coefficients. The power of the polynomial is variable but in the typical case is 3.

Figure 4:
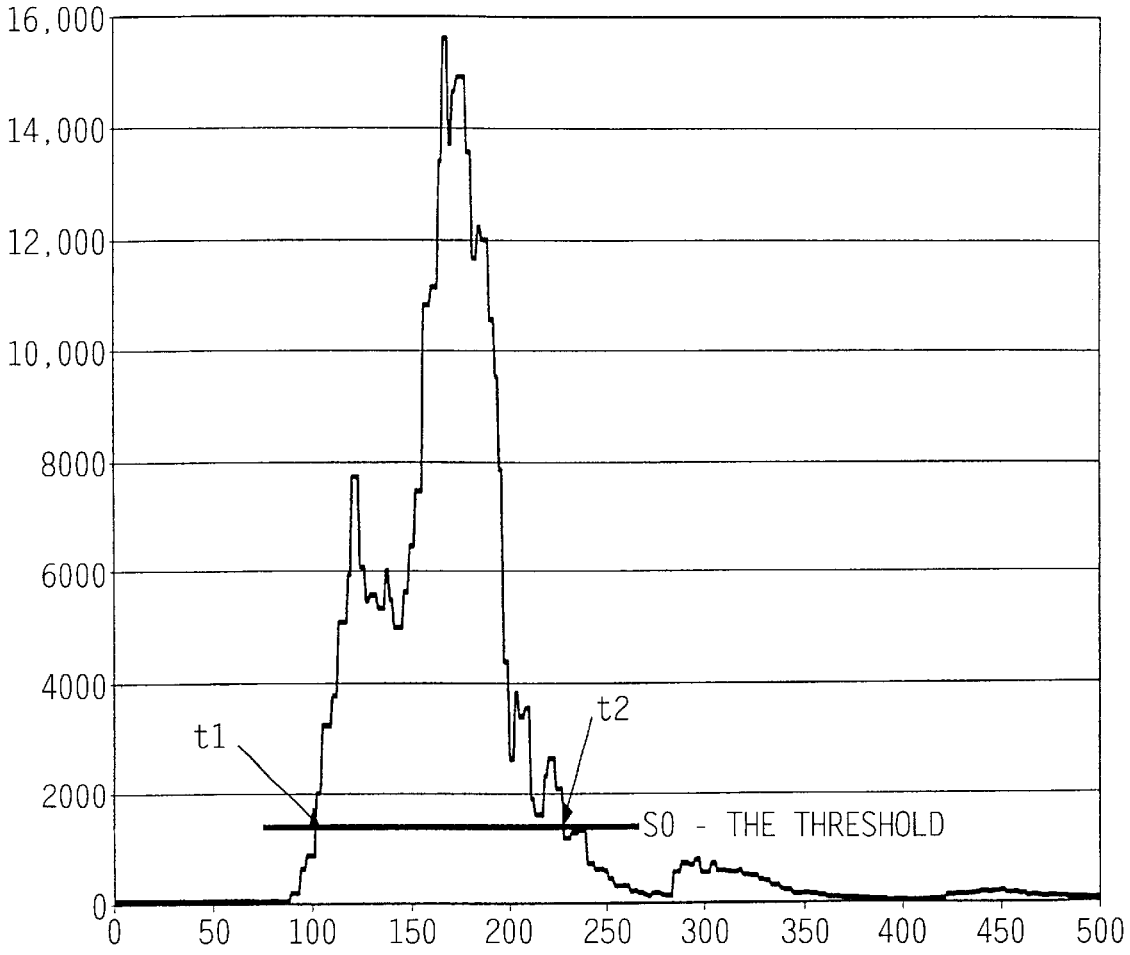
FIG. 4 is a graph of smoke intensity versus time for a typical soiled oven and illustrating the preferred technique for determining the cleaning cycle duration time.

FIG. 4 is a graphic illustration of the preferred technique for measuring S(i) in order to ultimately calculate the duration of cleaning cycle time. As illustrated, during the initial no-smoke period, a baseline of zero is established by the described iterative measurements. After the detector 16 begins to detect smoke and S(i) exceeds the predefined threshold SO, additional measurements of S(i) are iteratively made (e.g., every 1 second) until S(i) falls below the SO threshold. Thereupon, the S(i) values between t1 and t2 are averaged to obtain P, and P is used to determine the cleaning cycle duration time. In the FIG. 4 illustration, the threshold SO is set at an S(i) value of approximately 1200, the scaling coefficient C is 1, and the polynomial coefficients are a0=−538, a1=0.040527273, a2=−5.272727E-07 and a3=0. It is anticipated that in actual practice the scaling coefficient C will be selected so that the value P is equal to 1 at maximum scattering signal.

After the smoke measurement period has elapsed, the controller 20 operates to close valve 48 and also informs the main range controller 44 of the time at which the cleaning cycle is to terminate. Thus, when the oven 10 is heavily soiled, copious amounts of smoke are generated during the t1–t2 measurement period, thus leading to a longer cleaning cycle duration. Of course, when the oven 10 is less soiled, a smaller quantity of smoke will be generated during the t1–t2 period, and a correspondingly shorter cycle time will be used.

Where the FIG. 3 sensor 16*a* is used, ambient-derived air is drawn by convection through opening 52 and along the length of the chamber to and through opening 54. This stream of ambient air is located between the sensor 30 and the oven gas and smoke passing through the sensor. Inasmuch as these flows are essentially laminar in nature, there is very little intermixing of the oven gas and ambient streams. The use of an ambient air stream is this fashion serves to protect the sensor 30 from smoke contamination and buildup of residues thereon.

Those skilled in the art will appreciate that the invention is subject to many possible variations. For example, the measuring chamber may be specially sized or configured for a particular oven and cleaning duty. Furthermore, while an infrared smoke detector is preferred for reasons of cost and availability, any other type of known smoke detector could be employed. While the controller 20 is shown as separate from the main range controller 44, it will be understood that the electronics for the controlling assembly 12 may be built into the main range controller itself.

It may also be desirable to add a filter in the line 46 to separate heavy grease and oil components from the smoke entering chamber 16. This will prevent sensor contamination while still allowing smoke to enter the chamber. Furthermore, while the exhaust from the chamber 16 is shown as a tube 50, this may be replaced by one or more holes in the chamber body.

I claim:

1. An oven cleaning cycle time-controlling assembly for use with an oven having interior and a cleaning cycle which generates smoke, said assembly comprising:

a sensing chamber;

a passageway communicating the interior of said oven and the sensing chamber in order to convey at least a portion of said smoke generated during a cleaning cycle to the sensing chamber;

a smoke detector associated with said chamber in order to measure a parameter of the smoke in the chamber during at least a portion of said cleaning cycle; and a controller coupled with said detector and oven that terminates said cleaning cycle in response to said measured parameter.

2. The assembly of claim 1, said smoke detector being an infrared smoke detector.

3. The assembly of claim 1, said parameter being the average value of smoke intensity during a portion of said cleaning cycle.

4. The assembly of claim 1, including a valve interposed in said passageway for selectively establishing or terminating the communication between said oven interior and said chamber.

5. The assembly of claim 4, said controller operably coupled with said valve for selective operation of the valve.

6. The assembly of claim 1, said chamber presenting an oven gas inlet and an oven gas outlet whereby gas from said oven including said smoke passes through the sensing chamber.

7. The assembly of claim 6, said chamber further having an ambient gas inlet and an ambient gas outlet arranged so that a stream of ambient air passes through the sensing chamber during passage of said oven gas therethrough, said stream of ambient air passing between said detector and said oven gas.

8. The combination comprising:

an oven having an interior and a cleaning cycle which generates smoke; and an oven cleaning cycle time-controlling assembly including a sensing chamber;

a passageway communicating the interior of said oven and the sensing chamber in order to convey at least a portion of said smoke generated during a cleaning cycle to the sensing chamber;

a smoke detector associated with said chamber in order to measure a parameter of the smoke in the chamber at least a portion of said cleaning cycle; and a controller coupled with said detector and oven that terminates said cleaning cycle in response to said measured parameter.

9. The combination of claim 8, said smoke detector being an infrared smoke detector.

10. The combination of claim 8, said parameter being the average value of smoke intensity during a portion of said cleaning cycle.

11. The combination of claim 8, including a valve interposed in said passageway for selectively establishing or terminating the communication between said oven interior and said chamber.

12. The combination of claim 11, said controller operably coupled with said valve for selective operation of the valve.

13. The combination of claim 8, said chamber presenting an oven gas inlet and an oven gas outlet whereby gas from said oven including said smoke passes through the sensing chamber.

14. The combination of claim 13, said chamber further having an ambient gas inlet and an ambient gas outlet arranged so that a stream of ambient air passes through the sensing chamber during passage of said oven gas therethrough, said stream of ambient air passing between said detector and said oven gas.

15. A method of controlling the cleaning cycle time of a self-cleaning oven, said cleaning cycle generating smoke, said method comprising the steps of:

using a smoke detector to measure a parameter of at least a portion of said smoke generated at least a portion of a cleaning cycle; and terminating said cleaning cycle in response to said measured parameter.

16. The method of claim 15, including the step of passing said portion of said smoke into a measuring chamber separate from said oven, said smoke detector associated with said measuring chamber.

17. The method of claim 16, including the steps of continuously passing said portion of said smoke through the sensing chamber, and simultaneously drawing ambient gas into and through said sensor, said ambient gas being between said smoke detector and said smoke.

18. The method of claim 15, said smoke detector being an infrared smoke detector.

19. The method of claim 15, said parameter being the average value of smoke intensity during a portion of said cleaning cycle.

* * * * *